United States Patent [19]

Gibson

[11] Patent Number: 5,074,815

[45] Date of Patent: Dec. 24, 1991

[54] LIFESAVING EQUIPMENT

[76] Inventor: William C. Gibson, 123,2345 Cedar Hill Cross Road, Victoria, B. C., Canada, V8P 5M8

[21] Appl. No.: 549,310

[22] Filed: Jul. 9, 1990

[30] Foreign Application Priority Data

Jul. 7, 1989 [CA] Canada ..... 605153

[51] Int. Cl.[5] ..... B63H 16/04

[52] U.S. Cl. ..... 440/101; 441/125; 416/74

[58] Field of Search ..... 440/98, 101-103; 441/80, 129, 88-124, 125; 416/69, 74

[56] References Cited

U.S. PATENT DOCUMENTS

| | | | |
|---|---|---|---|
| 1,289,123 | 12/1918 | Decowski | 441/106 |
| 1,504,011 | 8/1924 | Anderson | 441/106 |
| 4,302,194 | 11/1981 | Perales | 440/101 |
| 4,527,984 | 7/1985 | Gilbert | 440/101 |
| 4,619,622 | 10/1986 | McDonald | 441/106 |
| 4,804,345 | 2/1989 | Lee | 440/101 |
| 4,820,216 | 4/1989 | Masters | 440/101 |
| 4,926,772 | 5/1990 | Bright | 440/101 |

FOREIGN PATENT DOCUMENTS

| | | | |
|---|---|---|---|
| 1406380 | 6/1965 | France | 440/101 |

*Primary Examiner*—Joseph F. Peters, Jr.
*Assistant Examiner*—Clifford T. Bartz
*Attorney, Agent, or Firm*—Nixon & Vanderhye

[57] ABSTRACT

An improved storage container for a lifesaving device is provided herein. Such storage container includes the combination of an oar or paddle, the upper end of which is hollowed-out, to give a pocket of sufficient dimension to accommodate an inflatable lifesaving device which is in deflated form, e.g., an inflatable life jacket or life raft which is in deflated form. A quickly- and easily-removable cap is provided at the inboard end of the hollowed-out pocket to retain such lifesaving device therewithin.

2 Claims, 1 Drawing Sheet

LIFESAVING EQUIPMENT

Figure 1:
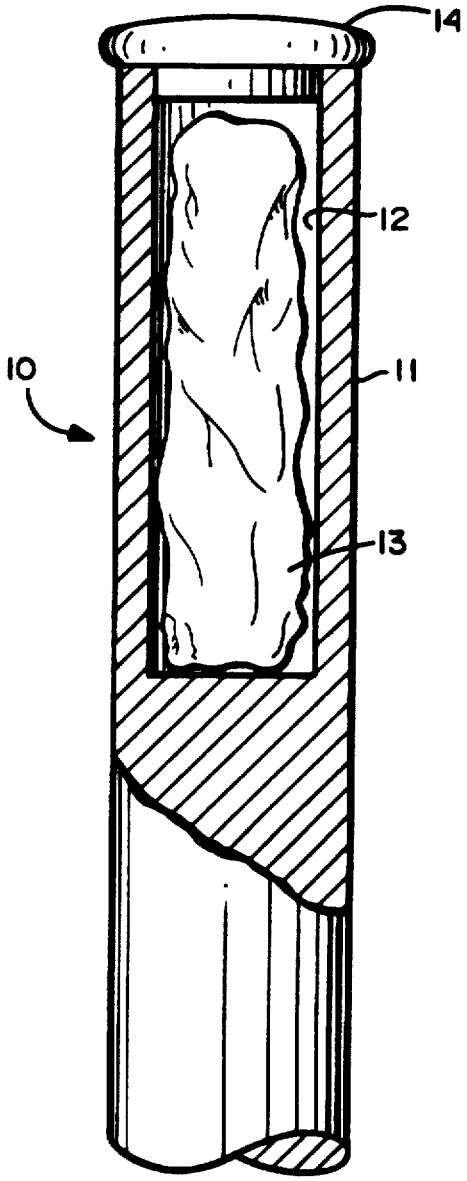

This invention relates to a storage container for a lifesaving device.

Many lifesaving devices are stored in the open on a vessel, and are thus prone to corrode or to entangle the feet. There are some instances where it would be desirable to store such lifesaving devices within an appliance which is in common use aboard certain classes of boats, e.g., racing sculls.

Paddles or oars having hollow portions are common in the art. For example, U.S. Pat. No. 3,411,166 patented Nov. 19, 1968 by J. A. Kimmel, provided a paddle which included an outer sleeve having hollow or buoyant paddle blades at the outboard ends thereof, in order to provide a lighter weight paddle.

U.S. Pat. No. 3,800,734 patented Apr. 2, 1974 by L. Y. Whang, provided a water propulsion device which used a flexible compression head mounted in a hollow shaft with a hollow handle at the end of the shaft. It was taught therein that there must be no obstruction between the handle and the shaft so that, for use in rowing, the compression head collapses on an upstroke and re-inflates on a downstroke.

U.S. Pat. No. 4,302,194 patented Nov. 24, 1981 by G. R. Perales, provided a combined propulsion and support device having a spherical float body and a tubular member that extended through the float body with swim fins attached to the outboard and the tubular member.

U.S. Pat. No. 4,527,984 patented July 9, 1985 by S. Gilbert, provided a water oar stick which included a pole with a hollow handle mounted at one end thereof.

All these patents are directed to lighter weight oars or paddles and do not suggest any other utility.

An object of a broad aspect of the present invention is the provision of a hollow-handled oar or paddle which may be used to store a lifesaving device therewithin.

By the present invention, an improvement is provided in a storage container for a lifesaving device, the improvement comprising an oar or paddle, the upper end of which is provided with a hollowed-out pocket of sufficient dimension to accommodate an inflatable lifesaving device, e.g. a life jacket or a life raft, which lifesaving device is in deflated form; and a quickly- and easily-removable cap at the inboard end thereof to retain such lifesaving device therewithin, whereby, in an emergency, the inflatable lifesaving device is removed from the hollowed-out pocket and is inflated for use as a lifesaving device.

This invention also provides the combination of: an oar or paddle, the upper end of which is provided with a hollowed-out portion; an inflatable life jacket or life raft which is in deflated form accommodated therewithin; and a quickly- and easily-removable cap at the inboard end thereof, whereby, in an emergency, the inflatable life jacket or life raft is removed from the hollowed-out pocket and is inflated for use as a lifesaving device.

In the accompanying drawings, the single FIGURE shows a partial cross-section of one embodiment of the oar or paddle of the present invention.

The invention 10 is in the form of an oar or paddle, the upper portion 11 being hollowed-out to form a storage pocket 12, within which is stored a deflated inflatable life jacket or life raft. The chamber 12 is closed by a quickly- and easily-removable cap 14.

In case of emergency about a water craft equipped with such oars, the cap may be quickly- and easily-removed and the life jacket or life raft removed, and inflated for lifesaving use.

The embodiments of the invention in which an exclusive property or privilege is claimed are defined as follows:

1. An improvement in a storage container for a lifesaving device, said improvement comprising: an oar or paddle, the upper end of which is provided with a hollowed-out pocket of sufficient dimension to accomodate an inflatable life jacket or life raft which is in deflated form therein; of said pocket containing said inflatable life jacket or life raft; and a quickly- and easily-removable cap at the inboard end of said oar or paddle to retain said inflatable life jacket or life raft therewithin, whereby, in an emergency, said inflatable life jacket or life raft is removed from said hollowed-out pocket and is inflated for use as a lifesaving device.

2. The combination of: an oar or paddle, the upper end of which is provided with a hollowed-out portion; an inflatable life jacket or life raft which is in deflated form accommodated therewithin; and a quickly- and easily-removable cap at the inboard end thereof whereby, in an emergency, said inflatable life jacket or life raft is removed from said hollowed-out pocket and is inflated for use as a lifesaving device.

* * * * *